US006347970B1

(12) United States Patent
Weinel

(10) Patent No.: US 6,347,970 B1
(45) Date of Patent: Feb. 19, 2002

(54) DEPLOYABLE RECOVERY SYSTEM FOR SNOWMOBILE AND RIDER

(76) Inventor: John Thomas Weinel, 9928 Oak Shore Dr., Lakeville, MN (US) 55044

( * ) Notice: Subject to any disclaimer, the term of this patent is extended or adjusted under 35 U.S.C. 154(b) by 0 days.

(21) Appl. No.: 09/643,810

(22) Filed: Aug. 22, 2000

(51) Int. Cl.[7] ..... B63C 9/00
(52) U.S. Cl. ..... 441/80; 114/68
(58) Field of Search ..... 114/44, 54, 123, 114/68; 441/80

(56) References Cited

U.S. PATENT DOCUMENTS 2,374,296 A * 4/1945 Ming ..... 114/54
2,642,693 A * 6/1953 Broady ..... 114/54
5,150,662 A * 9/1992 Boyd et al. ..... 114/68
5,682,832 A * 11/1997 Millard ..... 114/123
6,070,546 A * 6/2000 Downey et al. ..... 114/123

* cited by examiner

*Primary Examiner*—Stephen Avila
(74) *Attorney, Agent, or Firm*—Gregory F. Cotterell

(57) ABSTRACT

An improvement in a snowmobile comprising an inflatable bladder in an initial folded and un-inflated conditioned, operably connected to the frame of the snowmobile by at least one flexible strap and operably connected to an inflation medium controlled by a deployment system. In response to detection of water submersion, the deployment system activates the inflation medium rapidly inflating the bladder, which releases from its folded, un-inflated condition and floats at the surface of the water with the snowmobile suspended and submerged below the inflated bladder, still connected to the bladder by the at least one flexible strap. When submerged the float acts as a recovery device for retrieving the snowmobile and a rescue device for the rider to climb up on. The submerged snowmobile further stabilizes the bladder by acting as a sea anchor.

10 Claims, 2 Drawing Sheets

DEPLOYABLE RECOVERY SYSTEM FOR SNOWMOBILE AND RIDER

FIELD OF THE INVENTION

This invention relates to a deployable system for a snowmobile that provides for recovery of the snowmobile and its rider from open water. More specifically, the invention provides a deployable flotation device, including an inflatable float and harness, that when deployed, suspends the snowmobile from the float into the water while providing a rescue platform for the rider(s) out of the water.

BACKGROUND OF THE INVENTION

For those regions of the world where winter temperatures often remain well below freezing for at least several months of the year, snowmobiles are frequently, if not preferably, used for transportation or recreation. Snowmobiles are well adapted for traveling over snow or ice having at least two forward steerable skis, a motor of some sort, and a rearward motor driven traction belt. The rider(s) generally sits straddled upon a longitudinally oriented bench seat just behind the engine-enclosing coloring and windscreen and over the drive train and traction belt.

Snowmobiling is not without its dangers. In Minnesota alone, there have been one hundred deaths recorded in just the last 20 years attributable to snowmobile riders that have drowned because they inadvertently drove their snowmobile over ice that was too thin to support the weight of the snowmobile. Not only is there the unfortunate loss of life, but there is also the contamination of the environment by the lost snowmobile.

This problem with drowning and loss of the machine has been the subject of several patents. For instance, U.S. Pat. No. 4,893,692 issued to Smith discloses a snowmobile having a plurality of closed cell foam blocks spread about the snowmobile, from pontoon like forward skis, to the enclosed engine compartment and the rearward cargo storage area. With the Smith device, the closed cell foam is always inflated.

U.S. Pat. No. 5,150,662 issued to Boyd, et al., discloses a snowmobile having a plurality of inflatable bladders distributed about the snowmobile. These bladders are inflated upon immersion of the snowmobile into water. The entire system is intended to float the snowmobile and its rider(s) on the surface of the water.

U.S. Pat. No. 5,682,832 issued to Millard discloses a snowmobile very similar to Boyd, et al., wherein there are a plurality of inflatable bladders distributed about the snowmobile. The difference lies in that these bladders are intended to be deflatable and restored within their respective housings. This disclosure anticipates a snowmobile driver being able to intentionally traverse open water with this floatation system deployed.

What all three disclosures have in common are floatation systems designed to buoy the vast bulk of the snowmobile and its rider(s) above the surface of the water. To do so requires a considerable amount of flotation capacity. This is because of the weight involved. On average, a snowmobile weighs at least five hundred pounds. On average, a rider weighs approximately 150 pounds, not including their wet winter clothing, boots, helmet and gloves. However, most, if not all snowmobiles, are designed to hold at least two riders. Consequently, any of the above mentioned systems must carry sufficient flotation capacity to support at least eight hundred pounds of snowmobile and riders out of the water.

This is not an easy task, requiring considerable bulk when stored or deployed.

What is needed is a deployable flotation device, providing rescue capabilities for the rider(s) of a snowmobile and retrieval of the snowmobile after immersion of the snowmobile and rider(s) in open water, that is compact, lightweight and easily stored within the snowmobile.

SUMMARY OF THE PRESENT INVENTION

The present invention relates to a snowmobile having a frame, an engine for propelling the snowmobile, which is mounted to and operably connected to the frame, and steerable skis operably connected to the frame. The improvement of the present invention comprises an inflatable bladder that is in an initial folded and un-inflated condition preferably housed within some portion of the frame and operably connected to the frame by at least one flexible strap. An inflation medium, such as a compressed gas in a pressure cylinder, is mounted within the frame and is operably connected to the inflatable bladder. With a compressed gas this operable connection would be a fluid connection suitable for handling pressurized gas. The inflation medium is controlled by a deployment subsystem, mounted within the frame, which is designed to first sense submersion of the snowmobile within water and then activates the inflation medium to inflate the bladder. When inflated, the bladder floats at the surface of the water with the snowmobile submerged and suspended below the bladder by the at least one flexible strap.

An object of the present invention is to provide both a means of rescue for a rider of the snowmobile, as well as a means for recovering the snowmobile, as well. The inflatable bladder, when deployed, is sufficient to provide a top surface floating above the surface of the water onto which the rider may climb. The at least one strap connected between the inflatable bladder and the frame of the snowmobile is of sufficient strength to support the submerged weight of the snowmobile.

An object of the present invention is to provide an inflatable bladder sufficient to support the weight of two riders, presumably dressed in winter wear and drenched, and the weight of the submerged snowmobile. An advantage of the present invention is in it not trying to float the snowmobile. A snowmobile on land weighs at least five hundred pounds, but when submerged may weigh less than two hundred and fifty to only one hundred and fifty pounds. Consequently, the inflatable bladder of the present invention may be considerably smaller than flotation required to support the dry weight of the snowmobile and its rider(s). The smaller bladder is more easily compacted and stored on the snowmobile.

Another advantage of the present invention is stabilization of the bladder on the surface of the water. All floating objects have greater or lesser stability to rocking when someone attempts to climb aboard, or if aboard, move around. Stability is a function of the weight, surface area in contact with the water, and center of mass in relation to the center of buoyancy. Other devices that attempt to float the entire snowmobile remain fairly unstable because of the high center of mass in relation to the center of buoyancy contributing to rolling tendencies. This rolling tendency inhibits the ability of the rider(s) to climb aboard or stay aboard, or may even spill the hapless rider(s) back into the water.

The present invention anticipates submerging the snowmobile while remaining connected to the inflated bladder, considerably lowering the center of mass well below the center of buoyancy. In addition, the mass of the snowmobile also acts as a type of sea anchor, further stabilizing the recovery system.

The above and other objects and advantages of the present invention become more readily apparent when reference is made to the following detailed description taken in conjunction with the accompanying drawings. The following descriptions are in no way intended to limit the scope of the present invention.

DETAILED DESCRIPTION OF THE INVENTION

Figure 1:
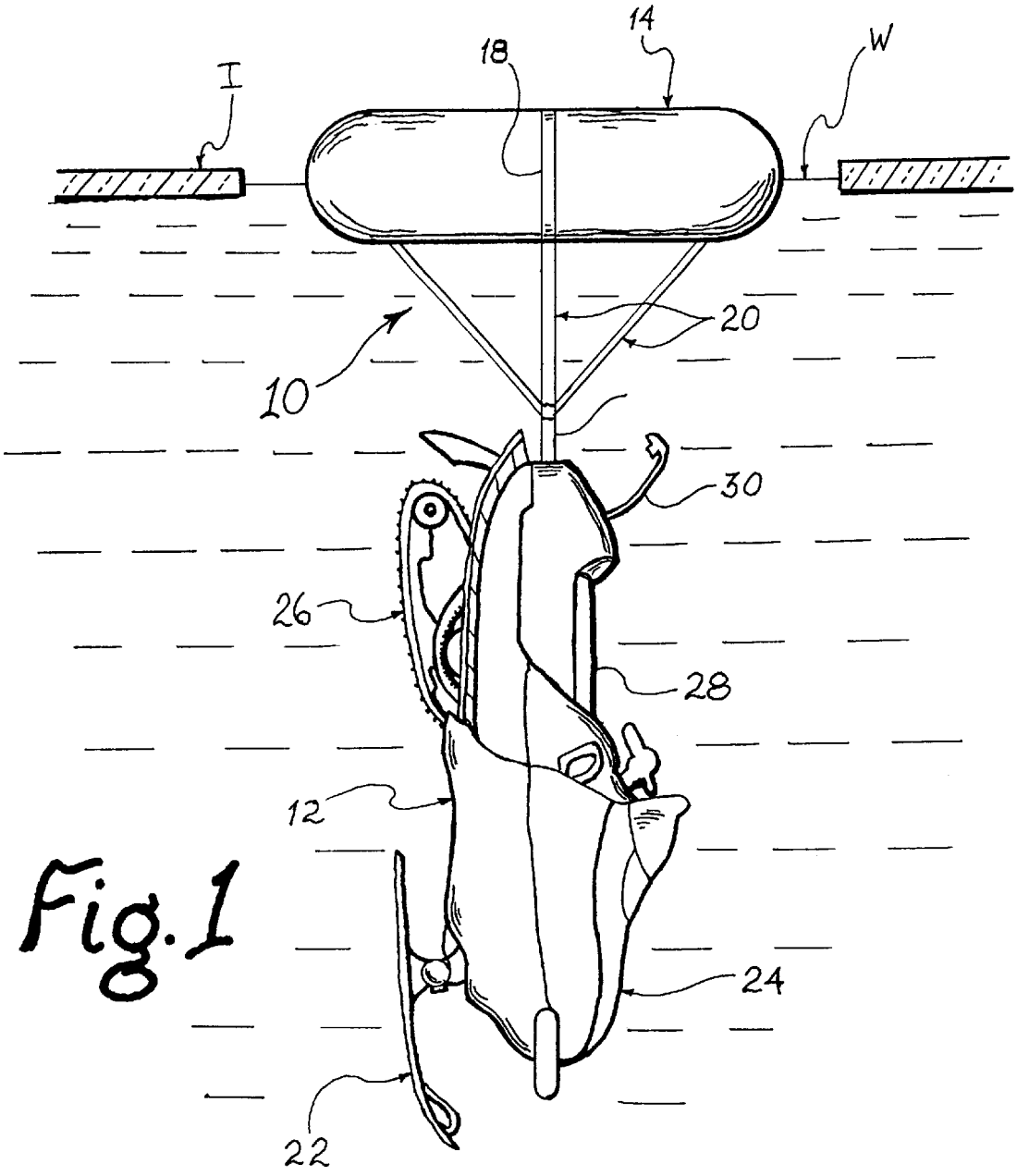
FIG. 1 is a side elevational view of an embodiment of the present device in a deployed configuration.
Figure 2:
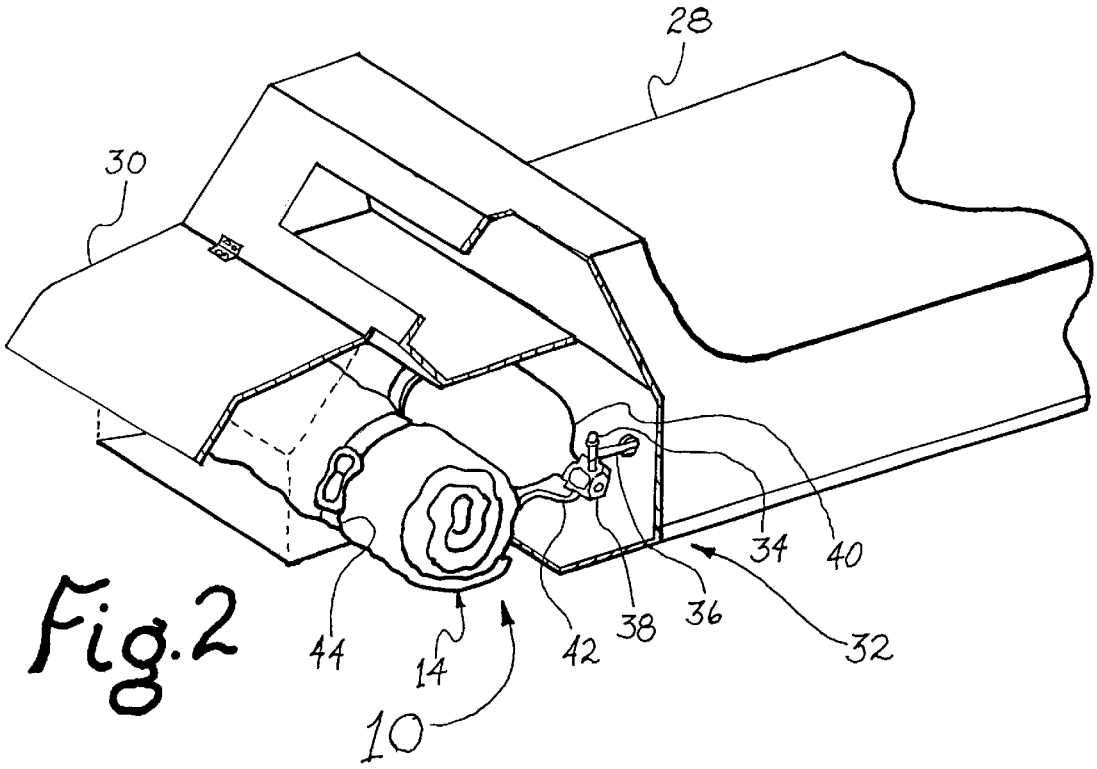
FIG. 2 is a cut away perspective view of a portion of the embodiment depicted in FIG. 1.
Figure 3:
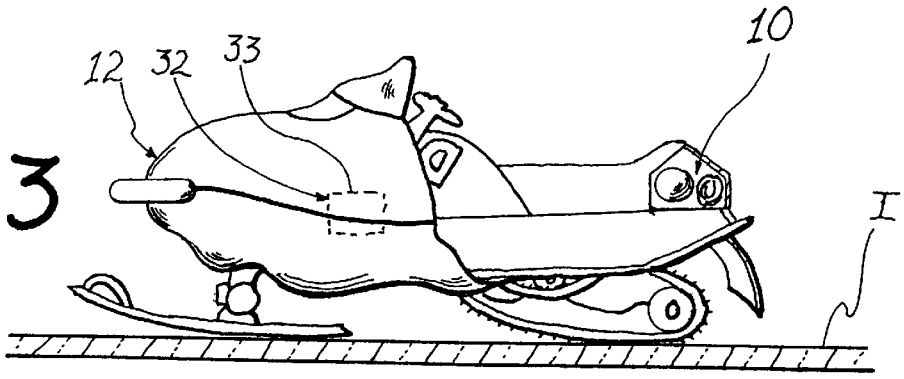
FIG. 3 is a side elevational view of the embodiment of FIG. 1 when it is not deployed.

Referring to FIGS. 1 through 3, wherein like numbers depict like components through out the various Figures, there is depicted a deployable recovery device 10 comprising an inflatable bladder 14 with a flexible anchor strap 16 coupled to the bladder 14 with a suspension subsystem 20. The other end of anchor strap 16 is mechanically connected to any suitable anchoring point on the frame (not shown) of a snowmobile 12.

Recovery device 10 further includes a deployment subsystem 32 comprising a submersion sensing unit 33 connected to a control valve 34 via a suitable conduit 36. Control valve 34 controls valve body 38 of pressure cylinder 40, which in turn, is fluidly connected to bladder 14 through valve body 38 and hose 42. Bladder 14 is securely mounted with a strap 44 within a seat cover 28 and under an access hatch 30.

Snowmobile 12 is generally comprised of a set of forwardly placed skis 22, an enclosing cowl 24 and a traction belt 26 along with seat cover 28. Generally, traction belt 26 is driven by an engine (not shown) housed within cowl 24.

Inflatable bladder 14 should be of a shape and size to support the rider(s), the submerged weight of the snowmobile, and still provide for the rider(s) to easily pull themselves out of the water while remaining stable on the water. A hollow, inflatable torus or nearly torus shape is preferable. Such a structure provides for lateral stability when a rider climbs up, the central opening insures that a rider will have access to the top side of bladder 14 should it completely fill the hole in the ice.

Inflatable bladder 14 may be made from any number of polymers and co-polymers suitable for use on water that are resistant to water and stable over time. A number of such polymers are polyethylene, polypropylene, polyester, polyurethane, poly(vinyl chloride), polyisobutylene, polychloroprene, and polybutadiene, to name a few. Preferably, these polymers and copolymers are combined with a strong polymeric fiber such as any of the aramids and nylons. In trials conducted to certify engineering concepts, a useful bladder was constructed out of polyurethane coated nylon fabric.

Flexible anchor strap 16 and suspension subsystem 20 are easily manufactured from polymeric webbing, such as nylon similar to car seat belts. The flexibility of these straps provides for the easy folding and storage in a small space, desirable for the present invention.

Deployment subsystem 32 may use any number of known submersion sensing units. Submersion may be detected mechanically through barometric change, electrically, or chemically. Regardless of the sensing modality, the submersion sensing unit is cooperatively connected to control valve 34 through suitable conduit 36. Conduit 36 may be electrical, mechanical, i.e., solid connectors or fluid connection such as a gas or liquid, or chemically connected where a chemical reaction leads to an altered state, such as dissolving a salt tablet. Valve body 38, when activated, releases the high pressure gas in pressure cylinder 40, which is used to rapidly inflate bladder 14 through hose 42. Pressure cylinder 40 is, preferably, a cylinder of compressed carbon dioxide.

Consequently, in operation, if a snowmobile enters open water W, through a hole in ice I or by inadvertently driving off a shore line into water, and begins to submerge, deployment subsystem 32 detects this through submersion sensing unit 33. The appropriate signal is then sent to control valve 34 via conduit 36, which opens valve body 38. Opening valve body 38 releases the contents of pressure cylinder 40, which then inflates bladder 14 through hose 42. The rapid and forceful expansion of bladder 14 releases bladder 14 from its restraining strap 44. Strap 44 may be constructed from any number of materials. A preferable strap is made from nylon meshing with the ends secured to each other using hook and loop material, such as Velcro®. A proper proportionate amount of hook and loop fastening material may be used to provide for adequate restraint of the folded compact bladder 14, yet give way in response to the expansion of bladder 14.

The inflation and expansion of bladder 14 also forces open hatch 30 at the end of seat cover 28. Once hatch 30 is opened, bladder 14 continues to inflate and expand, unfolding as it does so. When completely expanded, bladder 14 floats on the surface of water W. The submerged snowmobile is now suspended beneath the floating bladder 14, acting as a type of sea anchor, further stabilizing inflatable bladder 14 and increasing the ease with which a rider may climb onto the top of inflated bladder 14.

It should be noted that the present invention may be mounted practically anywhere about the frame of a snowmobile because of its compact size. The bladder, pressure cylinder, and deployment subsystem may just as easily be contained within its own housing, which is then secured to a point on the frame of the snowmobile. This may prove to be particularly useful as an after-market device for those snowmobiles already in use.

Through testing, the present invention, preferably, mounts at this rearward location for several reasons. The first is that the forward end of the snowmobile is heavier and sinks faster than the rearward end. This tends to tilt the rearward end upward in relation to the forward end, improving the ease of bladder deployment. Secondly, the seat cover naturally lends itself as a storage area in this rearward area.

The foregoing description is considered as illustrative only of the principles of the invention, since numerous modifications and changes will readily occur to those skilled in the art. Consequently, it is not desirable to limit the invention to the exact construction and operation shown and described herein. Accordingly, all suitable modification and equivalents may be resorted to, falling within the scope of the present invention.

I claim:

1. In a snowmobile having a frame, a motive power means for propelling the snowmobile operably connected to the frame, and steerable skis operably connected to the frame, the improvement comprising:

a torus shaped inflatable bladder in an initial folded and un-inflated conditioned and having a torus shape when inflated, operably connected to the frame by at least one flexible strap;

inflation means, operably connected to the inflatable bladder, for inflating the torus shaped inflatable bladder; and deployment means, operably connected to the inflation means, for sensing water submersion of the snowmobile and activating the inflation means to inflate the torus shaped inflatable bladder;

so that sensing submersion of the snowmobile activates the inflation means inflating the torus shaped inflatable bladder, which, when inflated, floats at the surface of the water with the snowmobile submerged below and connected to the torus shaped inflatable bladder by the at least on flexible strap.

2. The invention of claim 1 in which the inflatable bladder comprises a polymer.

3. The invention of claim 2 in which the polymer comprises a polymer selected from a list of polymers consisting of: polyethylene, polypropylene, polyester, polyurethane, poly(vinyl chloride), polyisobutylene, polychloroprene, and polybutadiene.

4. The invention of claim 2 in which the polymer comprises a polymeric fabric sheet in combination with a polymer coating.

5. The invention of claim 1 in which the inflation means comprises a pressure cylinder of compressed gas.

6. The invention of claim 5 in which the compressed gas comprises carbon dioxide.

7. The invention of claim 1 in which the deployment means comprises an electrical submersion sensor and electrical power source.

8. The invention of claim 1 in which the deployment means comprises a mechanical submersion sensor.

9. The invention of claim 8 in which the mechanical submersion sensor comprises a hydrostatic sensor.

10. The invention of claim 1 in which the deployment sensor comprises a chemical submersion sensor.

* * * * *